United States Patent [19]

Szatmari

[11] 4,007,416

[45] Feb. 8, 1977

[54] VOLTAGE REGULATING TRANSFORMER

[76] Inventor: Gabor Szatmari, 203 W. 16th St., Lumberton, N.C. 28358

[22] Filed: Aug. 6, 1975

[21] Appl. No.: 602,265

[52] U.S. Cl. ..... 323/60; 315/DIG. 2; 336/96

[51] Int. Cl.[2] ..... H01F 15/14; H05B 41/04

[58] Field of Search ..... 336/69, 181; 323/60, 323/61, 48; 315/DIG. 2, DIG. 5

[56] References Cited

UNITED STATES PATENTS

| | | | |
|---|---|---|---|
| 3,579,084 | 5/1971 | Moyer | 336/69 X |
| 3,688,232 | 8/1972 | Szatmari | 336/69 |
| 3,775,720 | 11/1973 | Winn | 336/69 |
| 3,890,540 | 6/1975 | Ott | 315/DIG. 5 |

*Primary Examiner*—Gerald Goldberg
*Attorney, Agent, or Firm*—Woodling, Krost, Granger & Rust

[57] ABSTRACT

A voltage regulating transformer is disclosed which includes a magnetic core and a primary winding connectable to an alternating current source for inducing an alternating magnetic flux in the magnetic core. The secondary winding comprises a plurality of paired sectioned windings responsive to the magnetic flux in the magnetic core. Each pair of the plurality of paired sectioned windings has a first and a second foil with a dielectric interposed between the first and the second foils thus creating a plurality of capacitors. One pair of the plurality of paired sectioned windings has a different number of turns than the other of the plurality of paired sectioned windings creating a potential imbalance upon interconnection of the paired sectioned windings. The potential imbalance produces an oscillation within the secondary winding at a frequency which is an odd harmonic of the frequency of the alternating current source providing a reinforcement of the magnetic flux during a portion of each cycle producing a greater peak output voltage. The invention is suitable for use with high-intensity discharge lamp regulators or ballasts which require a substantially high starting voltage in order to ignite the lamp. The foregoing abstract is merely a resume of one general application, is not a complete discussion of all principles of operation or applications, and is not to be construed as a limitation on the scope of the claimed subject matter.

18 Claims, 10 Drawing Figures

VOLTAGE REGULATING TRANSFORMER

BACKGROUND OF THE INVENTION

1. Field of the Invention

This invention relates to inductor devices and more particularly to voltage regulating transformers or ferroresonant transformers.

2. Description of the Prior Art

Ferroresonant transformer circuits also called constant voltage stabilizers, ballasts, constant voltage and/or current regulators, voltage regulating transformers and the like produce a substantially constant voltage, wattage or current output from a variable alternating voltage source. In general, such devices are driven by a sinusoidal electrical signal but square or other wave-shaped driving forces may be used to power the ferroresonant transformer. Many of these devices are used in high-intensity discharge lamp regulators or ballasts since such lamps require a substantially high starting voltage (open circuit voltage) in order to ignite the lamp. Before ignition takes place, the impedance of these lamps is almost infinite. After ignition takes place, the impedance of the lamp approaches zero and the current must be restricted by using an impedance in the external circuit. Each type of the high-intensity discharge lamps for example Mercury, Metal Halide, Sodium, etc. has an operating voltage, current and current crest factor for optimum operation, but all of the high-intensity discharge lamps have a high starting voltage and a very low impedance after ignition. It is therefore necessary to limit the current through the lamp by using the inductive-capacitive reactances of the regulator or the ballast circuit. However, the regulator and ballast circuit must be designed and constructed to meet maximum and minimum voltage requirements of the American Standards Association (ASA) specification C–78.1305–1965 or later revisions.

One undesirable characteristic of a mercury vapor lamp occurs when power is interrupted for one or more cycles after being in full operation. The arc is extinguished and will not reignite until the lamp cools or unless the hot lamp is subjected to a greater voltage than that originally to start the cool lamp. After cooling and reignition, the lamp undergoes a normal warm-up which may take between 10 and 20 minutes depending upon operating conditions. If a large factory is equipped with mercury vapor lamps and a short duration power failure occurs, the factory will be without suitable lighting for a period of 10 to 20 minutes.

Some in the prior art (U.S. Pat. No. 2,858,479 issued Oct. 28, 1958) have established an oscillation in the secondary winding to provide harmonic distortion of the magnetic flux to increase the peak voltage of the transformer. The disadvantage of the harmonic distortion was that the harmonic current continued after ignition of the lamp expending power without flowing through the lamp.

In my prior U.S. Pat. No. 3,688,232, I disclosed a novel apparatus for reducing the amount of material required in a transformer by graded capacitance and graded insulating material for optimum distribution of voltage and current through the transformer. Since this teaching is pertinent to the present invention, I hereby incorporate by reference said patent into the instant disclosure.

Accordingly, it is an object of this invention to overcome the aforementioned disadvantages of the prior art and to provide a voltage regulating transformer having means for modifying the magnetic flux in the magnetic core to increase the magnetic flux during each cycle to produce a higher peak output voltage in the secondary portion of the core.

Another object of this invention is to provide a voltage regulating transformer having a harmonic voltage in the secondary winding for producing a higher peak output voltage and which harmonic voltage is usable to power the load after ignition.

Another object of this invention is to provide a voltage regulating transformer incorporating oscillation in the secondary winding within a sectionalized integrated transformer as disclosed in my prior U.S. Pat. No. 3,688,232.

Another object of this invention is to provide a voltage regulating transformer having not only optimum inductance and capacitance but also current and voltage distribution to reduce cost and weight of the transformer.

Another object of this invention is to provide a voltage regulating transformer having integrated inductive and capacitive reactances thereby reducing the bulk of the transformer.

Another object of this invention is to provide a voltage regulating transformer having means to provide a voltage large enough for igniting a warm mercury vapor lamp after it has been extinguished and still be constructed within the voltage tolerances of the aforesaid ASA specification.

Another object of this invention is to provide a voltage regulating transformer including sectionalized capacitances interconnected by coupling capacitors to obtain a peak starting voltage capable of starting or restarting a cold or warm High Intensity Discharge (HID) vapor lamp.

Another object of this invention is to provide a voltage regulating transformer which can be easily wound on conventional coil and capacitor winding machines.

SUMMARY OF THE INVENTION

The invention may be incorporated in, a voltage regulating transformer having load terminals for transferring power from an alternating current source to a load, comprising in combination, a magnetic core, a primary winding connectable to the alternating current source and wound about said magnetic core for inducing an alternating magnetic flux therein, a secondary winding comprising a plurality of paired sectioned windings being wound around and responsive to said magnetic flux in said magnetic core, means establishing capacitance between said plurality of paired sectioned windings, means connecting said secondary winding to the load terminals, and means for modifying said alternating magnetic flux in said magnetic core to reinforce the magnetic flux therein at least during a portion of each cycle producing a greater output voltage to the load terminals.

DESCRIPTION OF THE PREFERRED EMBODIMENT

Figure 1:
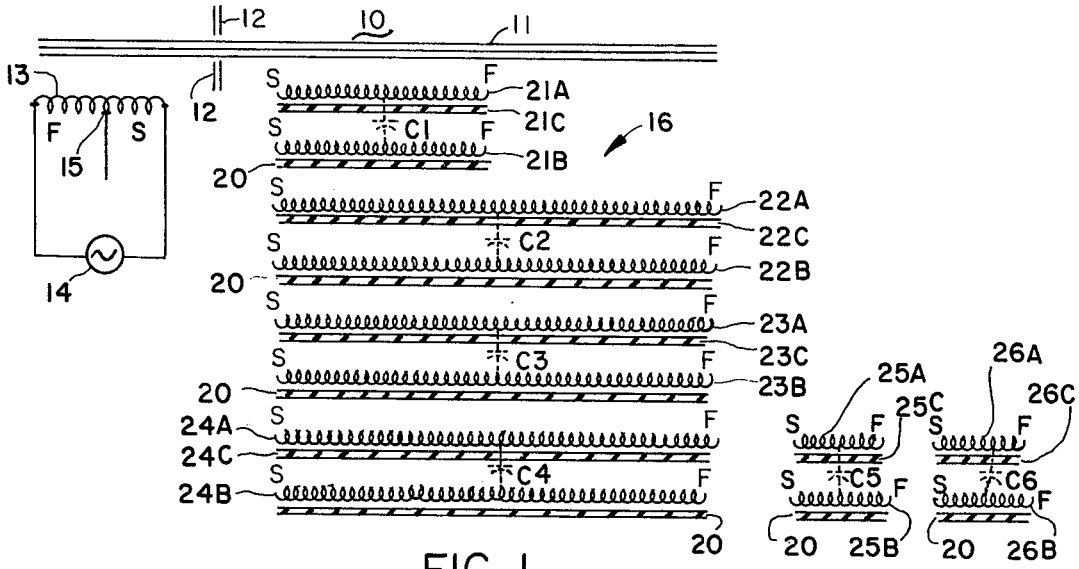
FIG. 1 is a schematic diagram of a voltage regulating transformer incorporating portions of the invention.

FIG. 1 illustrates a sectionalized integrated inductive capacitive transformer 10 comprising a magnetic core 11 which may be of conventional E-I configuration with a pair of magnetic shunts 12 separating a primary winding 13 from a secondary winding 16. The primary winding 13 has a tap 15 and is connectable to an alternating current source 14. The primary winding may be wound with round insulated copper wire or square, rectangular or hexangular shape whichever suits the individual design or application. The primary winding 13 has a first and second end respectively marked F and S which may also refer to the finish and start of the winding. Current from the alternating current source 14 will induce an alternating magnetic flux in the magnetic core 11 in accordance with the alternating current source 14.

The secondary winding 16 comprises a plurality of paired sectioned windings 21-26 which are wound about and responsive to the magnetic flux in the magnetic core 11. Each pair of the paired sectioned windings 21-26 has a first foil 21A-26A and a second foil 21B-26B with each foil having a first and a second end indicated as F and S in FIG. 1. The symbols F and S may also refer to the finish and start of the windings. Dielectric means including dielectrics 21C-26C are interposed between the first foils 21A-26A and the second foils 21B-26B creating a plurality of capacitances shown in phantom as capacitors $C_1$–$C_6$. The dielectric means also includes dielectrics 20 separating adjacent foils to provide electric isolation. The sectioned windings 21A and 21B have a different number of turns than the sectioned windings 22A-24A and 22B-24B and, the foils 25A-26A and 25B-26B have a different number of turns that the remaining foils 21A-24A and 21B-24B.

The alternating current source 14 establishes a potential along each of the foils 21A-26A and 21B-26B in accordance with the number of turns of each of the respective foils. For example 50 volts may be developed between the ends of foils 21A and 21B whereas 100 volts may be developed between the ends of foils 22A-24A and 22B-24B. Since the foils are not interconnected the voltages are floating voltages and no potential difference will exist in capacitors $C_1$–$C_6$ and accordingly no current will flow.

Figure 2:
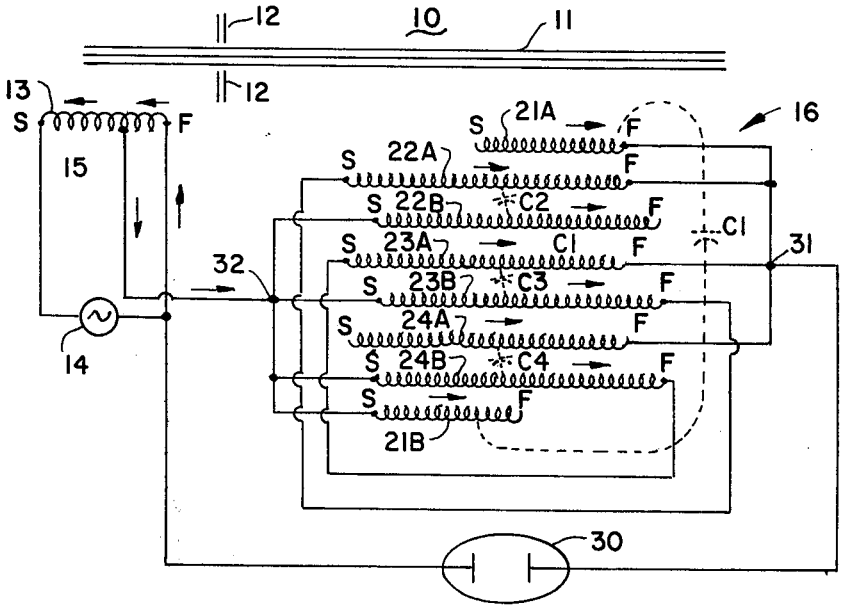
FIG. 2 is a schematic diagram of the transformer shown in FIG. 1 interconnected and under an open circuit condition.

FIG. 2 is a schematic diagram of the transformer shown in FIG. 1 connected to a load 30 shown as a mercury vapor lamp. The first ends F of the first foils 21A-24A are connected through first transformer terminal 31 to the load 30 whereas the second ends S of the second foils 21B-24B are connected through a second transformer terminal 32 and a portion of the primary winding 13 by tap 15 to the load 30. Assuming 100 volts is developed across each of the sectioned windings 22A-24A and 22B-24B and 50 volts is developed across sectioned windings 21A and 21B then a capacitive current will flow through capacitor $C_1$ as shown by the arrows each one-half of the cycle of the alternating current source 14. This capacitive current attempts to equalize the potential between foils 21A and 21B by charging capacitor $C_1$. The physical placement of foils 21A-24A and 21B-24B indicate the approximate voltages which appear on the foils. As a potential is developed in capacitor $C_1$, capacitive currents flow through capacitors $C_2$–$C_4$ in opposition to the charging of capacitor $C_1$. A steady state condition occurs when the charge $Q_1$ on the first capacitor $C_1$ is equal to the sum of charges $Q_2$, $Q_3$, and $Q_4$ on capacitors $C_2$, $C_3$ and $C_4$: or $$Q_1 = Q_2 + Q_3 + Q_4:$$

and the energy $W$ is $$W = C/2\ E^2$$

where $C$ is the capacitance and $E$ is the applied voltage. These capacitive currents induce a magnetic flux in the magnetic core 11. With the proper capacitances $C_1$–$C_4$, and proper inductances of windings 21A-24A and 21B-24B, the current flow within capacitors $C_1$–$C_4$ will be a harmonic frequency of the frequency of the alternating current source 14. Accordingly, the current flows through capacitors $C_1$–$C_4$ will modify the magnetic flux in the secondary portion of the magnetic core 11 produced by the alternating current source 14 resulting in a larger peak to peak voltage than obtainable by just the fundamental of the alternating current source 14.

Figure 3:
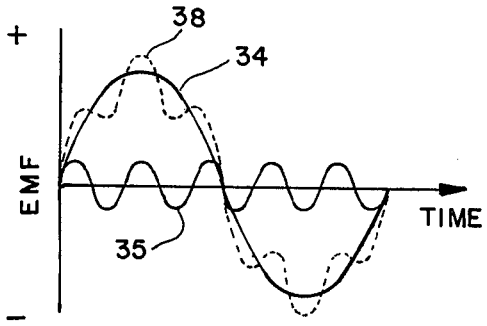
FIG. 3 is a wave diagram showing reinforcement of the fundamental magnetic flux by a fifth harmonic.

FIG. 3 is a graph showing the voltage as a function of time which is applied to the mercury vapor lamp 30 in FIG. 2. The fundamental 34 is shown as a sine wave and is produced by the alternating current source 14. A fifth harmonic 35 is produced by the harmonic oscillation within the secondary winding 16. The harmonic oscillation within the secondary winding 16 modifies the fundamental flux in the magnetic core 11 producing a resultant wave form 38 which has a higher peak to peak voltage than the fundamental 34. In this example, the peak to peak voltage has been increased by approximately 10 percent to 15 percent. The third harmonic may also be used with proper phase corrections between the fundamental and a third harmonic to provide increased voltage of the peaks of the fundamental sine wave. The root mean square (RMS) voltage of the modified wave form 38 is less than the fundamental wave form 34. Accordingly, the invention sacrifices the RMS voltage by introducing harmonics to provide a higher peak voltage for igniting the mercury vapor lamp 30.

The minimum root means square (RMS) voltage to ignite a mercury vapor lamp at −20° F is 225 volts which is equivalent to 635 volts peak to peak. If the fundamental voltage is distorted by harmonics as shown in FIG. 3, the resultant peak to peak voltage is 700 to 730 volts. The alternating current source 14 may vary ±10 percent. With the proper selection of odd harmonics, the minimum peak voltage requirement of 635 volts for igniting the lamp 30 can be obtained even when the alternating current source 14 is at a minimum level. The peak to peak voltage with harmonic distortion is sufficient to start a cold mercury vapor lamp (−20° F) but is insufficient to restart an extinguished hot lamp.

Figure 4:
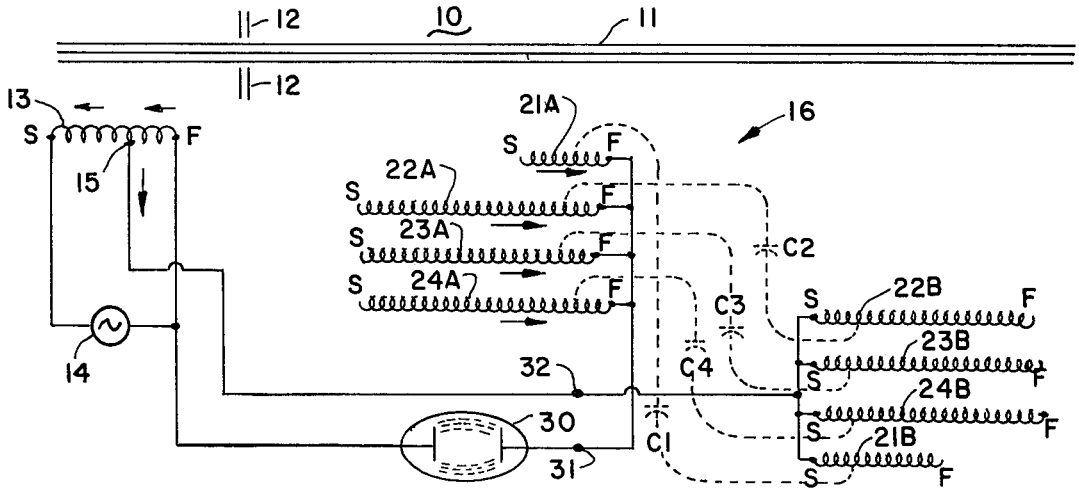
FIG. 4 is a schematic diagram of the transformer shown in FIGS. 1 and 2 under a load condition.

FIG. 4 shows the transformer circuit in FIG. 2 after ignition of the mercury vapor lamp 30 as indicated by the dashed lines within the lamp 30. The physical position of the sectioned foils 21A-24A relative to foils 21B-24B indicates the voltage relationship therebetween. After ignition of the mercury vapor lamp 30, the impedance of the lamp is very low compared to the pre-ignition impedance and the voltage across the integral capacitors $C_1$–$C_4$ increases to absorb the voltage in the circuit to limit the current flow through the mercury vapor lamp 30. The electrical position of the foils shown in FIG. 4 shows the large amount of voltage across capacitors $C_1$–$C_4$.

Some in the prior art have attempted to use oscillation of a secondary winding in order to increase the peak potential for igniting a mercury vapor lamp or the like. However those devices had the disadvantage that the oscillating current would flow continuously irrespective of whether the circuit was in a load or a no-load condition. In addition, the oscillating current did not flow through the load. An examination of FIG. 4 indicates that the oscillating current in the secondary windings 16 instantaneously enters windings 21B-24B at the second ends is transferred through capacitors $C_1$–$C_4$ and exits through the first ends of foils 21A-24A. All the secondary winding currents provide electrical power for the mercury vapor lamp 30.

Figure 5:
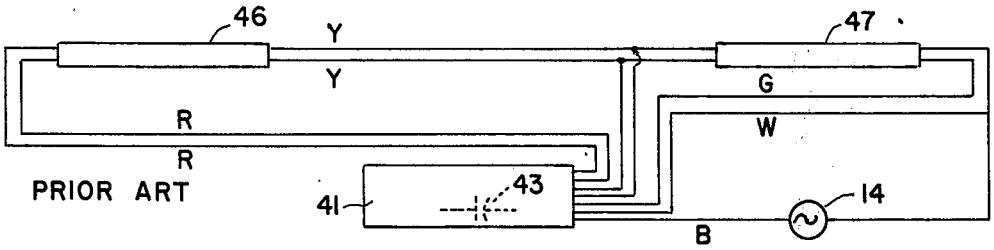
FIG. 5 shows a prior art ballast circuit for energizing two fluoresent lamps.

FIG. 5 represents a conventional prior art circuit having a high power factor for operating cold start (−20° F) fluorescent lamps 46 and 47 such as two 48T12, 60T12, 72T12,. 80T12, or 96T12 lamps. The diagram shows the ballast 41 including a ballast capacitor shown in phantom as 43 connecting the alternating current source 14 to the fluorescent lamps 46 and 47. The letters B, G, R, W, and Y correspond to the colors black, green, red, white, and yellow which are the standard colors used in the lamp configuration shown in FIG. 5. The cost of capacitor 43 may represent 15 percent to 30 percent of the total material cost of the ballast. Accordingly, the invention shown in FIG. 1 is of significant economic importance to fluorescent ballast application.

Figure 6:
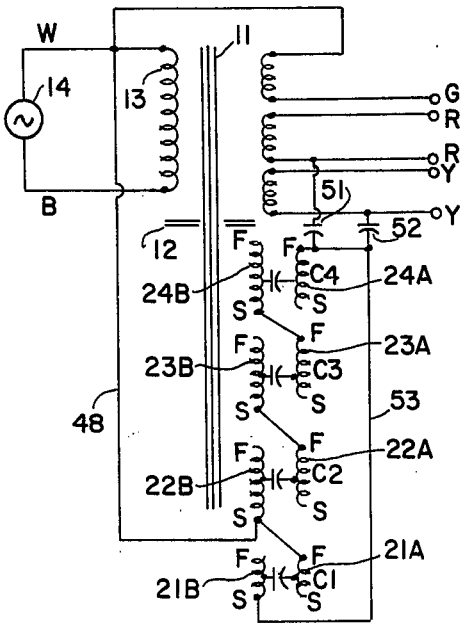
FIG. 6 is a schematic diagram of the invention applied to the circuit in FIG. 5 under a no load condition.

FIG. 6 is a modification of the invention shown in FIG. 1 for use in the circuit in FIG. 5. The letters B, G, R, W and Y correspond to the colors black, green, red, white and yellow connected to the circuit in FIG. 5. The foils are connected with capacitors $C_1$–$C_4$ in series rather than in parallel as in FIG. 2. The second ends of the second foils 22B-24B are connected to the first end of the first foils 21A-23A respectively. The second end of the second foil 22B is connected through conductor 48 to the G terminal whereas the first end of the first foil 24A is connected through capacitors 51 and 52 to the R and Y terminals respectively. The first end of the first foil 21A is connected to the second end of the second foil 22B with the second end of the foil 21B being connected through a conductor 53 to capacitors 51 and 52. Oscillation due to the voltage imbalance of foils 21A and 22B and remaining foils 22A-24A and 22B-24B cause harmonic distortion in the secondary portion of the magnetic core 11 to increase the voltage present on terminals Y and R terminals relative to the G terminals.

Figure 7:
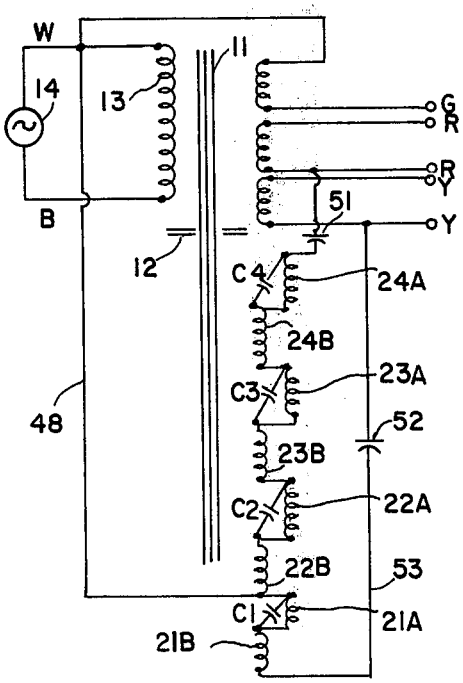
FIG. 7 is a schematic diagram of the transformer circuit shown in FIG. 6 under a load condition.

FIG. 7 illustrates the transformer shown in FIG. 6 after ignition of the fluorescent lamps 46 and 47 in FIG. 5. The potential required to operate the fluorescent lamp is substantially less then the potential required for ignition. The excessive voltage has been absorbed by the capacitive and inductive reactances of the transformer. The physical and electrical location of the foils in FIGS. 6 and 7 illustrate the voltage relationship between adjacent foils 21A-25A and 21B-25B. FIG. 7 is the electrical equivalent of FIG. 6 after ignition of the lamps.

Figure 8:
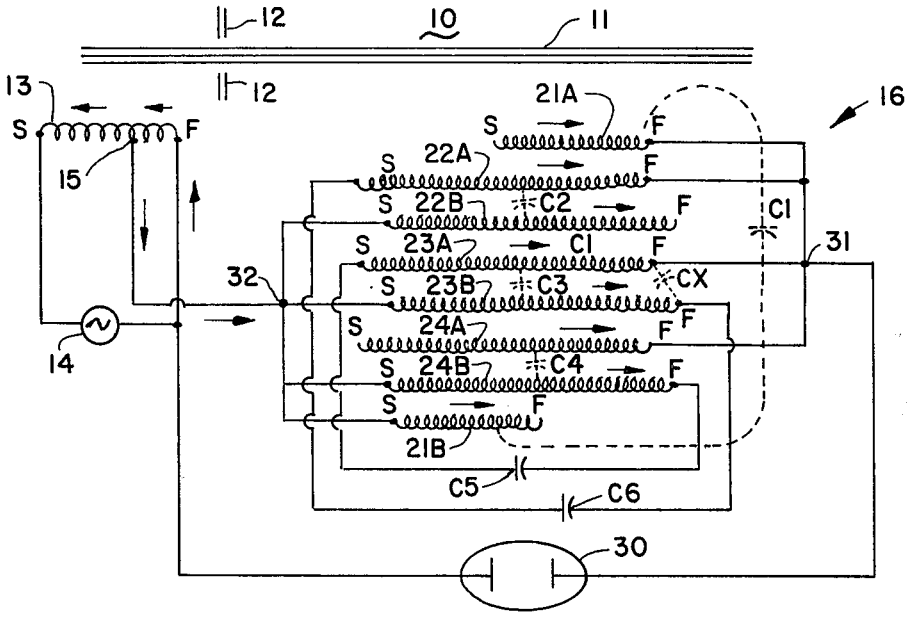
FIG. 8 shows the transformer of FIG. 2 incorporating coupling capacitors and under a no load condition.

FIG. 8 is a modification of FIG. 2 with the addition of auxiliary capacitors $C_5$ and $C_6$ interconnecting the paired sections of the secondary winding 16. Capacitor $C_5$ connects the first end of the second foil 24B to the second end of the first foil 23A whereas capacitor $C_6$ connects the first end of the second foil 23B to the second end of the first foil 22A. The capacitance of $C_5$ and $C_6$ may be wound adjacent the sectioned windings 21A and 21B in FIG. 1 depending on the winding process. Capacitors $C_5$ and $C_6$ are a small value compared to $C_1$–$C_4$ as shown by their relative size in FIG. 1 and may be 0.075 microfarads for example. Accordingly, capacitors $C_5$ and $C_6$ may be conventional external capacitors or conventional capacitors buried within the foils of the transformer.

The foils 21A-24A and the adjacent foils 21B-24B tend to have the same potential at adjacent points along the length of the foils as shown by the physical position of the foils. The second end of foil 24B may be assumed to be 0 volts whereas the first end of foil 24B may be assumed to be 100 volts. Capacitor $C_5$ will charge to approximately 100 volts producing a 200 volt potential on the second end of foil 23A. The first end of foil 23A will be approximately 300 volts. Since the foils 21A-24A tend to have the same potential at adjacent points on foils 21B-24B, the first end of foil 23B may be considered to be capacitively coupled to the first end of foil 23A by a phantom capacitor $C_x$. Capacitor $C_6$ will also charge to approximately 100 volts producing a 400 volt potential on the second end of foil 22A. Foil 22A will provide a 100 volt increase so that the first end of foil 22A will be approximately 500 volts.

Figure 9:
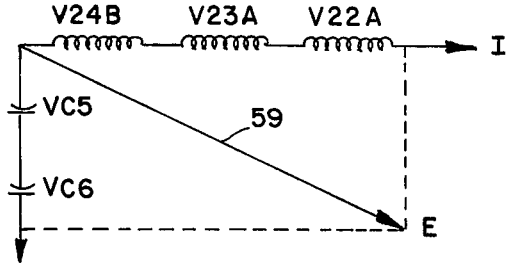
FIG. 9 is a phase diagram showing the resultant voltage of the transformer in FIG. 8.

FIG. 9 shows resultant voltage 59 of the vectorial sum of the inductive voltages V24B, V23A and V22A from foils 24B, 23A and 22A respectively and the capacitive voltage VC5 and VC6 from capacitors $C_5$ and $C_6$ respectively. If the potential difference between the first end of foil 24B and the second end of foil 23A is 100 volts then the energy W on capacitor $C_5$ will be $W = 0.075\text{uf}/2 \times (100 \text{ volts})^2 = 375 \times 10^{-6}$ Joules. A similar condition applies for capacitor $C_6$.

The charge and discharge of capacitors $C_5$ and $C_6$ are small compared to the charge and discharge of $C_1$–$C_4$. The potentials across capacitors $C_5$ and $C_6$ lag the inductive voltages V24B, V23A and V22A by 90° as shown in FIG. 9. The addition of capacitors $C_5$ and $C_6$ enables the transformer to ignite a hot mercury vapor lamp which had been extinguished for only a few cycles. Therefore, only a few additional cycles of the alternating current source are required before a steady state operation is again established in the lamp rather than 10 to 20 minutes required by the prior art transformers. This advantage is of prime economic importance in a large installation where a loss of lighting for 10 to 20 minutes may cost thousands of dollars. Accordingly, the instant invention has two independent and distinct means for increasing the igniting voltage of the mercury vapor lamp 30. Oscillation in the secondary winding produces a harmonic distortion of the fundamental magnetic flux within the secondary portion of the magnetic core 11 to increase the peak to peak output voltage of the transformer. In addition, capacitors $C_5$ and $C_6$ interconnect several sectioned windings in series providing an increased potential 59 which is a resultant of the inductive and capacitive voltages of the transformer shown in FIG. 2.

Figure 10:
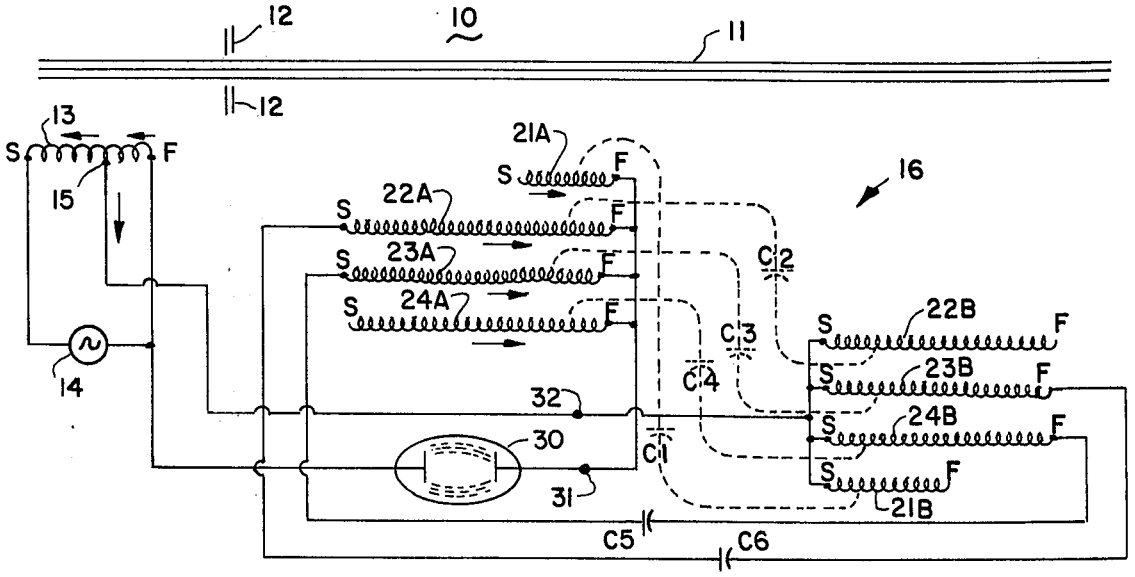
FIG. 10 shows the transformer in FIG. 8 in a load condition.

FIG. 10 shows the transformer circuit in FIG. 8 after ignition of the mercury vapor lamp 30 as indicated by the dashed lines within the lamp 30. The physical position of the sectioned foils 21A-24A relative to foils 21B-24B indicates the voltage relationship therebetween. After ignition of the mercury vapor lamp 30, the impedance of the lamp is very low compared to the pre-ignition impedance and the voltage across the integral capacitors $C_1$–$C_4$ increase to absorb the voltage in the circuit to limit the current flow through the mercury vapor lamp 30. The electrical position of the foils shown in FIG. 10 shows the large amount of voltage across capacitors $C_1$–$C_4$. An examination of FIG. 10 indicates that the oscillating current in the secondary windings 16 instantaneously enters windings 21B-24B at the second ends, is transferred through capacitors $C_1$–$C_4$ and exits through the first ends of foils 21A-24A. All the secondary winding currents provide electrical power for the mercury vapor lamp 30.

Although the invention has been described as an integral sectionalized transformer it is understood that the instant invention can be applied to conventional transformers using external components. It is also understood that the transformers set forth in the invention have been described by way of example to power various lamp sources but it is understood that the transformer can be used to power any load which is suitable for application with the transformer.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the circuit and the combination and arrangement of circuit elements may be restored to without departing from the spirit and scope of the invention as hereinafter claimed.

What is claimed is:

1. A voltage regulating transformer having load terminals for transferring power from an alternating current source to a load, comprising in combination:

a magnetic core;

a primary winding connectable to the alternating current source and wound about said magnetic core for inducing an alternating magnetic flux therein;

a secondary winding comprising a plurality of paired sectioned windings being wound around and responsive to said magnetic flux in said magnetic core;

means establishing capacitance between said plurality of paired sectioned windings;

means connecting said secondary winding to the load terminals;

and means for modifying said alternating magnetic flux in said magnetic core by harmonic magnetic flux to reinforce the magnetic flux therein at least during a portion of each cycle producing a greater output voltage to the load terminals.

2. A transformer as set forth in claim 1, wherein said means for modifying said alternating magnetic flux includes means establishing a potential imbalance between said paired sectional winding said secondary winding.

3. A transformer as set forth in claim 1, wherein said means for modifying said alternating magnetic flux includes means establishing one of said plurality of paired sectioned windings to have a potential difference from another one of said plurality of paired sectioned windings producing said harmonic magnetic flux in said magnetic core.

4. A transformer as set forth in claim 1, wherein said means for modifying said alternating magnetic flux includes one of said plurality of paired sectioned windings having a different number of turns from another of said plurality of paired sectioned windings.

5. A transformer as set forth in claim 1, wherein said harmonic magnetic flux includes means establishing oscillation within said secondary winding.

6. A transformer as set forth in claim 5, wherein said oscillation is at a frequency which is an odd harmonic of the alternating current source frequency.

7. A transformer as set forth in claim 1, wherein said means connecting said secondary winding to the load terminals includes a portion of said primary winding.

8. A transformer as set forth in claim 1, wherein each pair of said plurality of paired sectioned windings includes a first and a second foil with each of said foils having a first and a second end.

9. A transformer as set forth in claim 8, wherein said means connecting said secondary winding to the load terminals includes means connecting at least two of said plurality of paired sectioned windings in parallel with each other across the load terminals.

10. A transformer as set forth in claim 8, wherein said means connecting said secondary winding to the load terminals includes means connecting at least two of said plurality of paired sectioned windings in series with the load terminals.

11. A transformer as set forth in claim 1, wherein said means establishing capacitance between said plurality of paired sectioned windings includes dielectric means interposed between said sectioned windings of each pair.

12. A voltage regulating transformer having a first and a second load terminal for transferring power from an alternating current source to a load, comprising in combination:

a magnetic core having a magnetic shunt;

a primary winding connectable to the alternating current source and wound about said magnetic core for inducing an alternating magnetic flux therein;

a secondary winding separated by said magnetic shunt from said primary winding and comprising a plurality of paired sectioned windings and being wound around and responsive to said magnetic flux in said magnetic core;

each pair of said plurality of paired sectioned windings having a first and a second foil with each of said foils having a first and a second end;

one pair of said plurality of paired sectioned windings having a different number of turns than another pair of said plurality of paired sectioned windings;

dielectric means interposed between said first and second foils of each pair of said plurality of paired sectioned windings creating a plurality of capacitances;

means connecting said secondary winding to the first and second load terminals;

and means connecting said plurality of sectioned windings for modifying said alternating magnetic flux in said secondary portion of the magnetic core by harmonic magnetic flux to reinforce the magnetic flux therein during at least a portion of each cycle producing a greater peak output voltage to the load.

13. A transformer as set forth in claim 12, wherein said means connecting said secondary winding to the first and second load terminals includes means connecting said first ends of said first foils to the first load terminal and includes means connecting said second ends of said second foils to the second load terminal.

14. A transformer as set forth in claim 13, wherein said harmonic magnetic flux includes means establishing an oscillation within said secondary winding at a frequency which is an odd harmonic of the alternating current source frequency to increase the peak output voltage of said secondary winding.

15. A transformer as set forth in claim 12, wherein said means connecting said secondary winding to the first and second load terminals includes means connecting said plurality of capacitances in series with the first and second load terminals.

16. A voltage regulating transformer having load terminals for transferring power from an alternating current source to a load, comprising in combination:

a magnetic core;

a primary winding connectable to the alternating current source and wound about said magnetic core for inducing an alternating magnetic flux therein;

a secondary winding comprising a plurality of paired sectioned windings being wound around and responsive to said magnetic flux in said magnetic core;

means establishing capacitance between said plurality of paired sectioned windings;

means connecting said secondary winding to the load terminals;

and capacitance means interconnecting at least two of said sectioned windings in series across the load terminals whereby the voltage of said capacitance means and said sectioned windings are applied to the load terminals.

17. A transformer as set forth in claim 16, wherein said capacitance means includes a first and a second capacitor each connecting two of said sectioned windings in series across the load terminals.

18. A transformer as set forth in claim 17, including means for establishing said first and second capacitors to be in series with one another across the load terminals.

* * * * *